US006230425B1

(12) United States Patent
Ellison

(10) Patent No.: US 6,230,425 B1
(45) Date of Patent: May 15, 2001

(54) COMBINATION ORNAMENT AND GREETING CARD

(76) Inventor: Sandra K. Ellison, 3902 Versailles Dr., Tampa, FL (US) 33634

( * ) Notice: Subject to any disclaimer, the term of this patent is extended or adjusted under 35 U.S.C. 154(b) by 901 days.

(21) Appl. No.: 08/699,135

(22) Filed: Aug. 16, 1996

Related U.S. Application Data

(63) Continuation of application No. 08/420,025, filed on Apr. 11, 1995, now abandoned.

(51) Int. Cl.[7] ..... G09F 1/04
(52) U.S. Cl. ..... 40/124.01; 40/597
(58) Field of Search ..... 40/124.1, 597

(56) References Cited

U.S. PATENT DOCUMENTS

| | | | | |
|---|---|---|---|---|
| 1,922,900 | * | 8/1933 | Plante | 40/597 X |
| 1,932,154 | * | 10/1933 | Briggs | 40/597 |
| 3,668,796 | | 6/1972 | Patterson . | |
| 4,055,690 | * | 10/1977 | Patterson | 40/124.1 X |
| 4,087,576 | | 5/1978 | Patterson . | |
| 4,152,865 | * | 5/1979 | Ikeda | 40/124.1 X |
| 4,319,418 | * | 3/1982 | Transport | 40/124.1 |
| 4,439,941 | | 4/1984 | Halperin . | |
| 4,510,894 | * | 4/1985 | Girard | 40/124.1 X |
| 5,131,177 | * | 7/1992 | Sy, Jr. | 40/597 X |
| 5,213,371 | * | 5/1993 | Bradley | 40/124.1 X |
| 5,284,365 | | 2/1994 | Stuart . | |
| 5,303,957 | | 4/1994 | Barreca et al. . | |

* cited by examiner

*Primary Examiner*—Joanne Silbermann
(74) *Attorney, Agent, or Firm*—Holland & Knight LLP

(57) ABSTRACT

A greeting card assembly comprising (a) a card section having at least one aperture completely therethrough; and (b) a stained glass ornament including means for affixing said stained glass ornament to a vertical surface, wherein said stained glass ornament is affixed to said greeting card section via said means for attachment through said aperture.

13 Claims, 2 Drawing Sheets

COMBINATION ORNAMENT AND GREETING CARD

This application is a continuation of application Ser. No. 08/420,025 filed 04/11/95, now abandoned.

BACKGROUND OF THE INVENTION

1. Field of the Invention

The present invention is directed to a combination greeting card and decorative ornament. The decorative ornament is preferably a stained glass ornament, and is preferably removably attached to the greeting card using the same means with which the decorative ornament is affixed to a vertical surface (e.g., suction cup for attachment to a window, magnet for a refrigerator, etc.).

2. Description of the Related Art

The greeting card industry is very lucrative and very competitive. Attempts are constantly being made to produce greeting cards which stand apart from the ordinary greeting cards.

For example, U.S. Pat. No. 3,668,796 (Patterson) teaches a greeting card which folds flat for mailing and which can be folded into a three-dimensional ornament for decorative purposes. U.S. Pat. No. 4,087,576 (Patterson) teaches a greeting card which includes a folding, three-dimensional hanging ornament that can be punched out and hung for decorative purposes.

U.S. Pat. No. 4,439,941 (Halperin) teaches a card with a removable and reusable insert. The printed face of the greeting card is provided with an area having a reduced adhesive bonding ability, and a multi-colored embroidered emblem is releasably attached to the printed face of the greeting card. The recipient of the greeting card may remove the embroidered emblem and apply it to an article of clothing by the application of heat and/or pressure.

U.S. Pat. No. 5,284,365 (stuart) teaches a greeting card assembly including a basic greeting card member and a removable message insert assembly connected thereto. The message insert assembly includes a message insert member and an insert support assembly operable for connection to each other having the insert anchor tabs clamped and secured therebetween. The insert anchor tabs are operable to be severed to remove the removable message insert assembly from the basic greeting card member. The primary message insert member is connected to a cylindrical support member constructed of a magnetic material for ready attachment to an exterior surface of a refrigerator or other ferrous surface. Alternatively, the removable message insert assembly can be removed and used as a Christmas tree ornament.

U.S. Pat. No. 5,303,957 (Barreca et al.) teaches greeting cards including a portion comprised of transparent material having a colored pattern allowing the transmission of light therethrough and providing a stained glass effect. The card may be attached to a window to provide a stained glass window effect.

Given the high state of competition and the high degree of novelty necessary to attract the attention of the consumer, it is an object of the present invention to provide a greeting card which stands out and will be readily selected by the consumer.

It is a further object of the present invention to provide a vehicle for enhancing the sales of a stained glass ornament.

In view of the foregoing, it is an object of the present invention to provide a combination greeting card and decorative ornament which eliminates or minimizes the above-mentioned and other problems, limitations and disadvantages typically associated with conventional greeting cards, and to provide a combination greeting card and decorative ornament which is unique, visually stands out from ordinary greeting cards, and of which the enduring gift value will be immediately appreciated by the consumer.

SUMMARY OF THE INVENTION

These and other objects of the present invention have surprisingly been accomplished by the combination of a stained glass ornament, means for attaching a stained glass ornament to a vertical surface such as a window, and greeting card to which the stained glass ornament can be releasably affixed using the means for attaching a stained glass ornament to the vertical surface.

The foregoing has outlined rather broadly the more pertinent and important features of the present invention in order that the detailed description of the invention What follows may be better understood and that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other stained glass ornament and greeting card combinations for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a filler understanding of the nature and objects of the present invention reference should be made by the following detailed description taken in with the accompanying drawings in which.

DETAILED DESCRIPTION OF THE INVENTION

Figure 1:
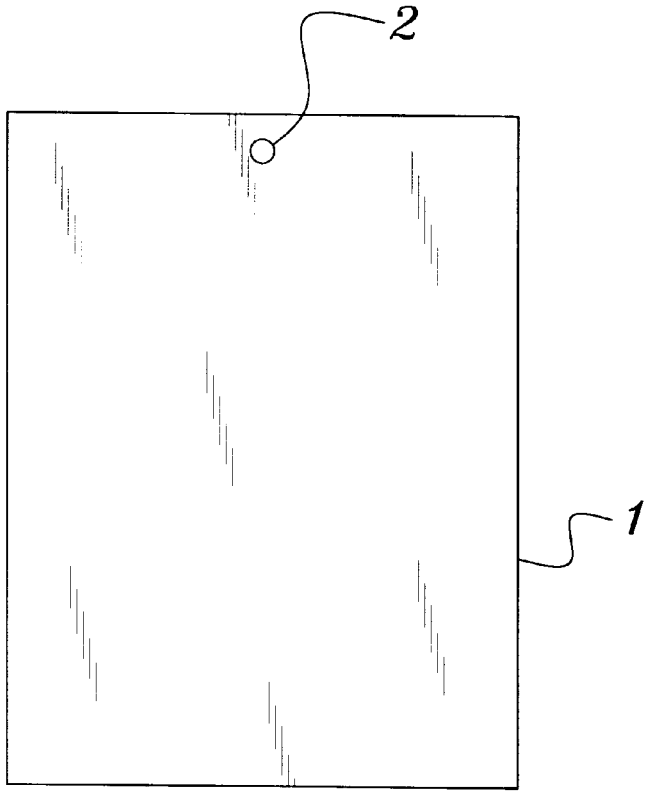
FIG. 1 is a front view of a blank greeting card with an aperture.
Figure 2:
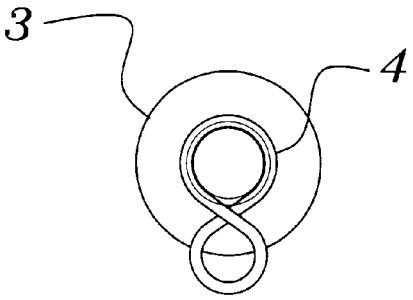
FIG. 2 is a front view of a suction cup and bent wire connector for use in combination with the card of FIG. 1.
Figure 3:
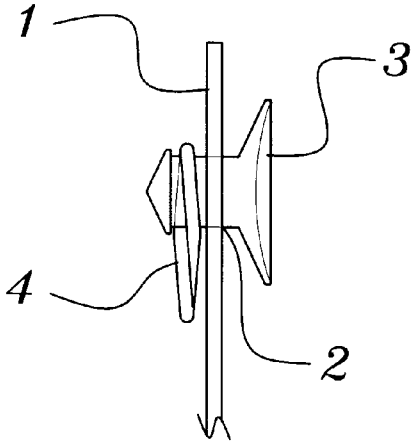
FIG. 3 is a side cross-sectional view showing the combination card, suction cup, and bent wire connector.
Figure 5:
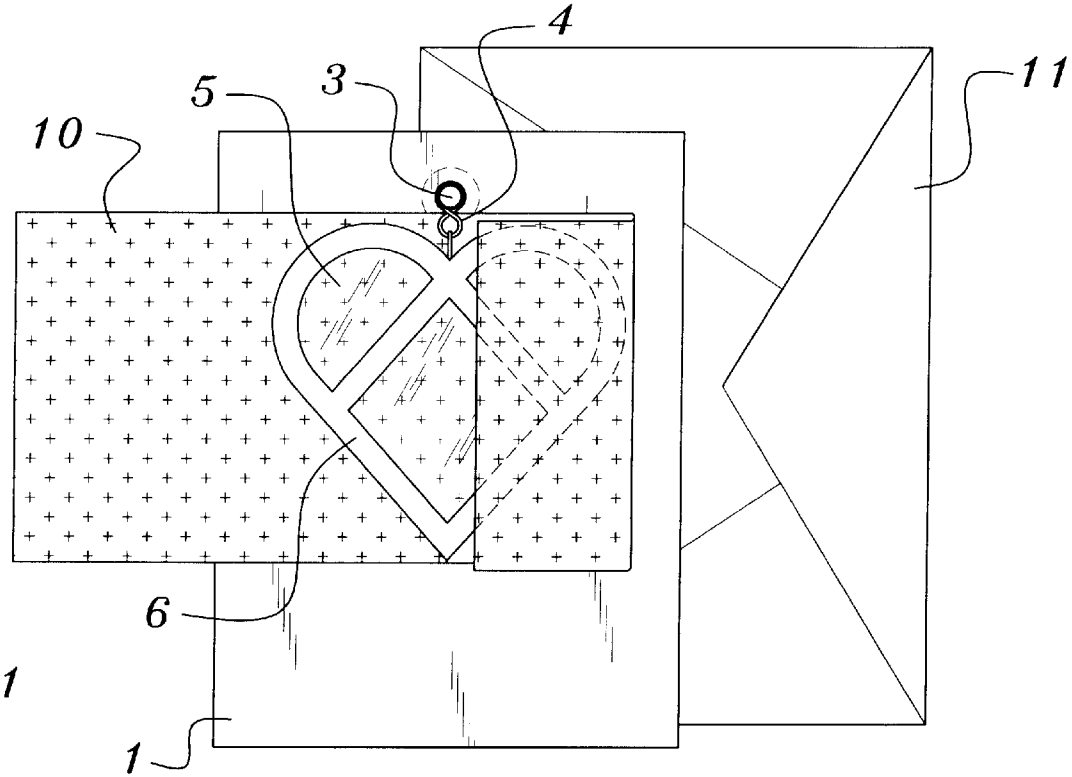
Fig. 5 is a front perspective view of the combination greeting card, suction cup, connector, ornament, envelope and material for wrapping ornament.

The present inventor has been working in the field of stained glass ornaments, and more particularly, stained glass ornaments which can be attached to windows or vertical surfaces by means of attachment means such as suction cups, releasable adhesive, permanent adhesive, hooks, a refrigerator magnet, etc. However, such items by themselves did not have sufficient novelty value to achieve significant sales in novelty stores, gift shops, etc. This is presumably due to the fact that such ornaments do not stand out when surrounded by other competing novelty items in the gift stores.

With respect to the unrelated field of greeting cards, as discussed above, there is intense competition between greeting cards for the attention and receptiveness of the consumer. The term "greeting card" as used in this specification and claims is meant to refer to a card having a decorative or artistic appearance and which includes thereon, therewith or therein a writing, which may be an inscription, in the form of a greeting. The greeting may be in connection with a holiday, a birthday, or any other occasion, whether special or not, the significant feature being that the sender intends to convey a message to a recipient. The card may be a single unfolded sheet, or may be folded so that part or all of the message is seen only when the card is opened or unfolded. The card may be made of plain paper, rigid paper stock, cardboard, plastic, wax treated paper, plastic treated paper, or any flat semi-rigid material.

The present inventor has discovered that miniature stained glass ornaments and greeting cards, each of which by themselves is not novel and thus does not stand out in a display area, can be combined to an article which surprisingly serves a number of uses and purposes which the previous separate items could not satisfy individually.

In order to understand the present invention, it is necessary to consider the quandary of the consumer. The consumer desiring to send a special message to a recipient may want to send an elaborate greeting card. However, greeting cards are old and well-known and frequently ignored by the recipient. An elaborate greeting card is frequently interpreted as an indication of extravagance and wasteful frivolity. On the other hand, a less extravagant greeting card may be interpreted as signifying a lack of willingness to spend money on behalf of the recipient, and thus may be interpreted as signaling a lack of interest or appreciation.

For a number of reasons, this consumer who desires to send a message would not, of his own volition, send a stained glass ornament.

First, there is no tradition or custom with respect to sending stained glass window ornaments. Since this is not a traditional gift, the meaning of such a gift may not be understood.

Second, stained glass windows are not readily available.

Third, glass is fragile, and it would not seem possible to send stained glass ornaments through the mail without a complicated and bothersome packaging and mailing procedure.

The present invention is based upon the discovery that a miniature stained glass ornament can be combined with a greeting card in a very simple, practical way to form a combination greeting card and gift, which combination can be easily sent through the mail. The consumer, seeing this combination, readily appreciates the significance and value of the combination, and selects this combination above other conventional greeting cards.

Surprisingly, the combination of a stained glass ornament and greeting card enables the purchaser to acquire, in one package, (1) a greeting card which expresses the sender's intentions, and (2) a permanent ornament which can be prominently displayed and which long outlasts a greeting card. The sender thus gives a gift which is practical in a package and is at the same time thoughtful, eloquent, simple, and beautiful.

That is, on special occasions such as Valentine's Day, Christmas, birthdays, etc., a person is usually required to send both a greeting card and a gift. This usually requires separate purchases of a greeting card, the selection of which may be difficult and time-consuming, and a gift, the selection of which is likewise difficult and time-consuming. The consumer desires to find a gift which is novel, which the recipient does not already have, which is tasteful and attractive, and which will be appreciated by the recipient.

This consumer, looking through the greeting card section, will discover the greeting card of the present invention and realize that he has in one package everything that satisfies the traditional requirements. The greeting card expresses the sentiment of the sender, includes a beautiful and meaningful gift, is simple, is novel, is tasteful, and is conveniently assembled for ready mailing and shipping.

That is, in a preferred embodiment of the invention, the combination greeting card and stained glass ornament according to the present invention is provided with a wrapping material such as "bubble wrap" so that it can be placed into the mail for shipping.

In a more preferred embodiment of the invention, the greeting card is provided with wrapping material and further with instructions for mailing or shipping.

Turning now to a specific example of the invention as shown in the figures, the greeting card printed member 1 is provided with an aperture 2 through which a means for attaching a stained glass ornament to a window, such as a suction cup 3, may be inserted. Once the suction cup is inserted through the aperture, the stained glass ornament including lead strips 6 and stained glass 5, which may be either colored or clear, can be attached via an attachment means 4 to the part of the suction cup 3 protruding through the greeting card so as to be displayed on the front surface of the greeting card 1. The combination greeting card and stained glass ornament may be prepared for mailing by encasing the ornament in the wrapping material 10 and inserting the combination greeting card and stained glass ornament into an envelope 11. The thus assembled stained glass ornament and greeting card provides a display for the stained glass ornament, a novel greeting card, and a novel gift idea combined into one.

Figure 4:
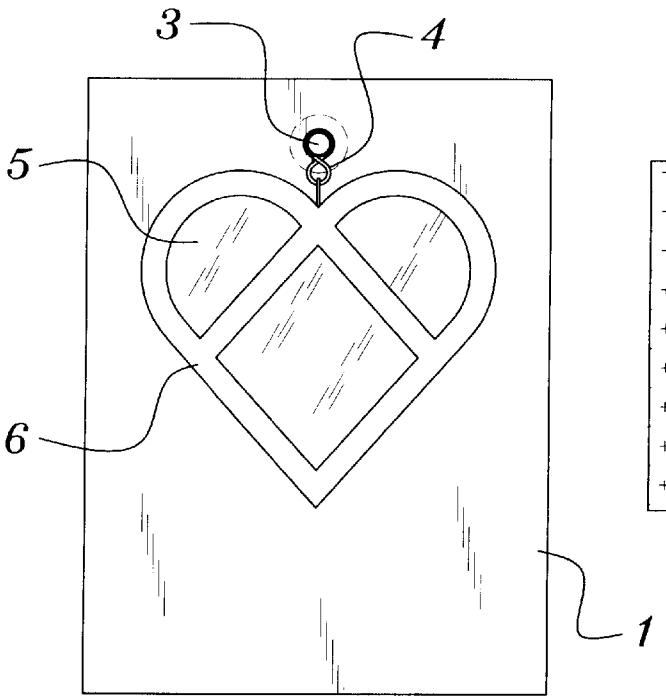
FIG. 4 is a front view of the combination greeting card, suction cup, connector and ornament.

In a preferred embodiment, a stained glass greeting card assembly is provided comprising a card part having a front surface and a back surface, and bearing a greeting on the front surface and/or, in the case that the card is folded, on an inside surface. The card has at least one aperture completely therethrough, i.e., so that a protruding element such as suction cup nipple can be introduced through the back of the card and project out the front of the card. A means for attachment to a vertical surface, such as a suction cup, a hook, a magnet for a refrigerator, an adhesive or semi-adhesive backed sticker with a peel-off backing, etc., is provided in a form so that a part of the attachment means can project through the aperture in the card, and the other part of the attachment means can not pass through. The stained glass ornament preferably comprises an ornament part, i.e., the artistic decorative stained glass ornament, and a connecting member such as a stiff wire element bent in the shape of a "figure 8" or a twisted figure 8 so that one loop can be attached to the ornament, and the other loop can be attached to the attachment means projecting through the card aperture. As shown in FIG. 4, the projecting part of the suction cup is releasably connected to a loop of the figure 8 shaped connecting member to hold the suction cup in place on the card.

Of course, other vertical surface attachment means may used in place of the suction cup member; other projecting parts can be used in place of the elastic nipple of the suction cup; and other connecting members may be used in place of the figure 8 shaped bent wire.

To use, the connecting member is released from the means for affixing to the vertical surface, the means for affixing to the vertical surface is withdrawn from the greeting card aperture, and the connecting member is again attached to the means for affixing to the vertical surface, so that the stained glass ornament can be attached to a vertical surface, such as a window, wall, lamp, etc, by the means for affixing to the vertical surface such as the suction cup member.

To assist those not familiar with the novel combination greeting card and stained glass ornament, the card section may be provided with instructions for removal and display of the stained glass ornament.

Thus, all requirements of the card and gift giving occasion are satisfied without any expenditure of energy on the part of the sender. The recipient is provided with a thoughtful, tasteful gift which the recipient will appreciate and can hang in a window for admiration by the recipient's friends. The sender will expect that the stained glass ornament will be displayed by the recipient, and this is a further incentive for the sender to purchase the present stained glass ornamental greeting card.

The present invention thus synergistically transforms a stained glass ornament and a greeting card, each of which individually had only moderately sales power, to a new item which has been found to have surprising significant sales power.

Although the novel combination greeting card and decorative ornament was first designed as a novelty gift item, it will be readily apparent that the combination is capable of use in a number of other applications. Although this invention has been described in its preferred form with a certain degree of particularity with respect to a combination greeting card and stained-glass ornament, it is understood that the present disclosure of the preferred form has been made only by way of example and that numerous changes in the details of structures and the composition of the combination may be resorted to without departing from the spirit and scope of the invention.

Now that the invention has been described,

What is claimed is:

1. A stained glass greeting card assembly comprising:

(a) a card part having a front surface and a back surface, and bearing a greeting and having at least one aperture completely therethrough;

(b) a stained glass ornament; and (c) means for affixing said stained glass ornament to a vertical surface, said means including a projecting part capable of projecting through said aperture and an anchoring part not capable of passing through said aperture;

wherein said projecting part of said means for affixing projects through said aperture in said greeting card part and protrudes outward from the front surface of said card part, and wherein said stained glass ornament is releasably attached to said projecting part.

2. A stained glass greeting card assembly as in claim 1, wherein said means for affixing is a suction cup.

3. A stained glass greeting card assembly as in claim 1, wherein said card is a folded card.

4. A stained glass greeting card assembly as in claim 1, wherein said card is made of paper.

5. A stained glass greeting card assembly as in claim 1, wherein said card is made of plastic.

6. A stained glass greeting card assembly as in claim 1, wherein said stained glass ornament is in the shape of a heart.

7. A stained glass greeting card assembly as in claim 1, wherein said stained glass ornament is in the shape of a cross.

8. A stained glass greeting card assembly as in claim 1, wherein said stained glass ornament is in the shape of a triangle.

9. A stained glass greeting card assembly as in claim 1, wherein said stained glass ornament includes a means for attaching the ornament to said means for affixing said stained glass ornament to a vertical surface.

10. A stained glass greeting card assembly as in claim 9, wherein said means for attaching the ornament to said means for affixing said stained glass ornament to a vertical surface is in the shape of a "figure 8".

11. A stained glass greeting card assembly as in claim 9, wherein said means for attaching the ornament to said means for affixing said stained glass ornament to a vertical surface is a metal wire.

12. A stained glass greeting card mailer assembly comprising:

(a) a card part having a front surface and a back surface, and bearing a greeting and having at least one aperture completely therethrough;

(b) a stained glass ornament;

(c) means for affixing said stained glass ornament to a vertical surface, said means including a projecting part capable of projecting through said aperture and an anchoring part not capable of passing through said aperture;

(d) an envelope dimensioned to receive said card and said stained glass ornament; and (e) a material for wrapping around said stained glass ornament and protecting it from shock;

wherein said projecting part of said means for affixing projects through said aperture in said greeting card part and protrudes outward from the front surface of said card part, and wherein said stained glass ornament is releasably attached to said projecting part.

13. A stained glass greeting card assembly comprising:

(a) a card part having a front surface and a back surface, and bearing a greeting and having at least one aperture completely therethrough;

(b) means for affixing said stained glass ornament to a vertical surface, said means including a projecting part capable of projecting through said aperture and an anchoring part not capable of passing through said aperture; and (c) a stained glass ornament including an ornament part and a connecting member in the shape of a "figure 8";

wherein said projecting part of said means for affixing projects through said aperture in said greeting card part and protrudes outward from the front surface of said card part, and wherein said stained glass ornament is releasably attached to said projecting part by means of said connecting member.

* * * * *